US007865120B2

(12) United States Patent
Suzuki et al.

(10) Patent No.: US 7,865,120 B2
(45) Date of Patent: Jan. 4, 2011

(54) IMAGE FORMING APPARATUS WITH POWER SUPPLY FOR CHARGING NIP FORMING MEMBER AND ROTARY FIXING MEMBER

(75) Inventors: Youhei Suzuki, Suntou-gun (JP); Tetsuya Yamamoto, Suntou-gun (JP); Michio Uchida, Susono (JP); Tomonori Shida, Boise, ID (US); Keisuke Mitsuhashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 356 days.

(21) Appl. No.: 12/098,078

(22) Filed: Apr. 4, 2008

(65) Prior Publication Data

US 2008/0253814 A1 Oct. 16, 2008

(30) Foreign Application Priority Data

Apr. 12, 2007 (JP) ..... 2007-104926

(51) Int. Cl.
*G03G 15/20* (2006.01)

(52) U.S. Cl. ..... 399/320; 399/331

(58) Field of Classification Search ..... 399/320, 399/331; 219/216

See application file for complete search history.

(56) References Cited

U.S. PATENT DOCUMENTS

| | | | |
|---|---|---|---|
| 2005/0123329 | A1 | 6/2005 | Uchida et al. |
| 2006/0233575 | A1 | 10/2006 | Uchida et al. |
| 2007/0116502 | A1 | 5/2007 | Shimizu et al. |
| 2008/0075490 | A1 | 3/2008 | Ota et al. |

FOREIGN PATENT DOCUMENTS

| | | | |
|---|---|---|---|
| JP | 64-65589 | | 3/1989 |
| JP | 305349 | | 4/2000 |
| JP | 2000-33807 | | 12/2000 |
| JP | 2001-92328 | | 4/2001 |
| JP | 2002-123109 | | 4/2002 |
| JP | 2002-251090 | | 9/2002 |
| JP | 2003084586 | A * | 3/2003 |
| JP | 2003-287967 | | 10/2003 |
| JP | 2004093753 | A * | 3/2004 |
| JP | 2004-212733 | | 7/2004 |
| JP | 2006-47556 | | 2/2006 |

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

The image forming apparatus includes a fixing apparatus capable of restraining offset of a toner in multifarious types of sheets and in a variety of environments at low costs. The fixing apparatus has a rotary fixing member and a nip forming member which forms a fixing nip portion by coming into contact with the rotary member. A recording material bearing an unfixed toner image is conveyed while being pinched by the nip portion. The fixing apparatus fixes a toner image onto the recording material. The fixing apparatus further has a bias applying means which applies a bias to the nip forming member. The bias applying means, before the recording material reaches the nip portion, applies a first bias to the nip forming member so that a surface of a rotary member is charged with electricity, and applies a second bias to the nip forming member while the recording material is conveyed by the nip portion.

10 Claims, 12 Drawing Sheets

IMAGE FORMING APPARATUS WITH POWER SUPPLY FOR CHARGING NIP FORMING MEMBER AND ROTARY FIXING MEMBER

BACKGROUND OF THE INVENTION

1. Field of the Invention

The present invention relates to an image forming apparatus such as a copying machine and a printer.

2. Description of the Related Art

In the image forming apparatus such as the printer, the copying machine and a facsimile that have hitherto employed an electrophotographic technology, a fixing apparatus 50 having a configuration illustrated in FIG. 14 has been widely adopted as means of fixing an unfixed toner image formed and borne on a recording material. The fixing apparatus 50 includes a heating unit 110 coming into contact with an unfixed toner image. The heating unit 110 has a rotary fixing member (hereinafter simply referred to as "sleeve") 102 such as an endless belt and a roller. The fixing apparatus 50 has a pressure roller 104 defined as a nip forming rotary member. A recording material P is conveyed and pinched by a fixing nip portion N formed between the sleeve 102 and the pressure roller 104, and undergoes image-fixation therein.

The image forming apparatus including the fixing apparatus 50 having the configuration described above has a problem that a toner T adhered to the surface of the sleeve 102 and the surface of the pressure roller 104 becomes offset to the recording material P.

Proposed for preventing this phenomenon is a method of applying a bias to a rotary fixing member or a nip forming rotary member of the pressure roller etc as hitherto typified by fixing apparatuses discussed in Japanese Patent No. 3053459, Japanese Patent Application Laid-Open No. 2000-338807 and Japanese Patent Application Laid-Open No. 2003-287967.

According to Japanese Patent No. 3053459, the bias is applied to only a fixing roller, and the offset is thus prevented. According to Japanese Patent Application Laid-Open No. 2000-338807 and Japanese Patent Application Laid-Open No. 2003-287967 each propose the method of applying the bias to both of a fixing film and the pressure roller.

As in Japanese Patent Application Laid-Open No. S64-065589, there is proposed a method of controlling a surface potential by coating a fluorine surface active agent over the surface of the roller.

The prior arts given above sufficiently satisfied the then-desired performance. In recent years, however, speed-up of the image forming apparatus has been requested by users, and a further improvement of the performance in terms of a task of flexibility to multifarious types of sheets has been also demanded of the image forming apparatus.

As a result, according to the configuration shown in Japanese Patent No. 3053459, it is difficult for one single bias power supply to set an optimum bias to the multifarious types of sheets and a variety of environments. Therefore, this has proven that there is a case in which the offset can not be completely restrained with respect to a specified type of sheet.

The system shown in Japanese Patent Application Laid-Open No. 2000-338807 solves the problem given above but needs to have two power supplies, which leads to a rise in costs. In terms of a trend toward lower prices over the recent years, a cost reduction is an indispensable issue, and the user's requests can not be satisfied by any technologies having none of high performance at low costs.

Japanese Patent Application Laid-Open No. 2003-287967 proposes a method by which one single power supply applies the bias to both of the fixing roller and the pressure roller. This method, however, has also proven that there is the case in which the offset can not be completely restrained with respect to the specified type of sheet as in the case of Japanese Patent No. 3053459.

As to Japanese Patent Application Laid-Open No. S64-065589, it is difficult to set the optimum surface potential to the multifarious types of sheets and the variety of environments, and it has been recognized that there is the case in which the offset can not be completely restrained with respect to the specified type of sheet.

SUMMARY OF THE INVENTION

It is an object of the present invention, which was devised in view of the problems described above, to provide an image forming apparatus capable of restraining the offset of an unfixed toner at low costs.

It is another object to provide an image forming apparatus including a toner offset restraining mechanism at low costs, which has flexibility to multifarious types of sheets and a variety of environments.

Still another object of the present invention is to provide an image forming apparatus which forms a toner image on a recording material, comprising: an image forming unit which forms an unfixed toner image on the recording material; a rotary fixing member which is brought into contact with the unfixed toner image; a nip forming member which forms a nip portion for conveying the recording material while pinching the recording material in a way that comes into contact with the rotary fixing member; and a power supply which applies a voltage to the nip forming member, wherein before a leading edge of the recording material enters the nip portion, said power supply applies a first voltage to said nip forming member, the first voltage having the same polarity as a charge polarity of the toner and being equal to or larger than a discharge starting voltage for starting a discharge to said rotary fixing member from said nip forming member, so that a surface of said rotary fixing member is charged with the same polarity as the charge polarity of the toner.

Further objects of the present invention will become apparent from the following detailed description of the exemplary embodiments with reference to the attached drawing.

DESCRIPTION OF THE EMBODIMENTS

An image forming apparatus according to the present invention will be described hereinafter in detail, with reference to the accompanying drawings.

First Embodiment

Figure 1:
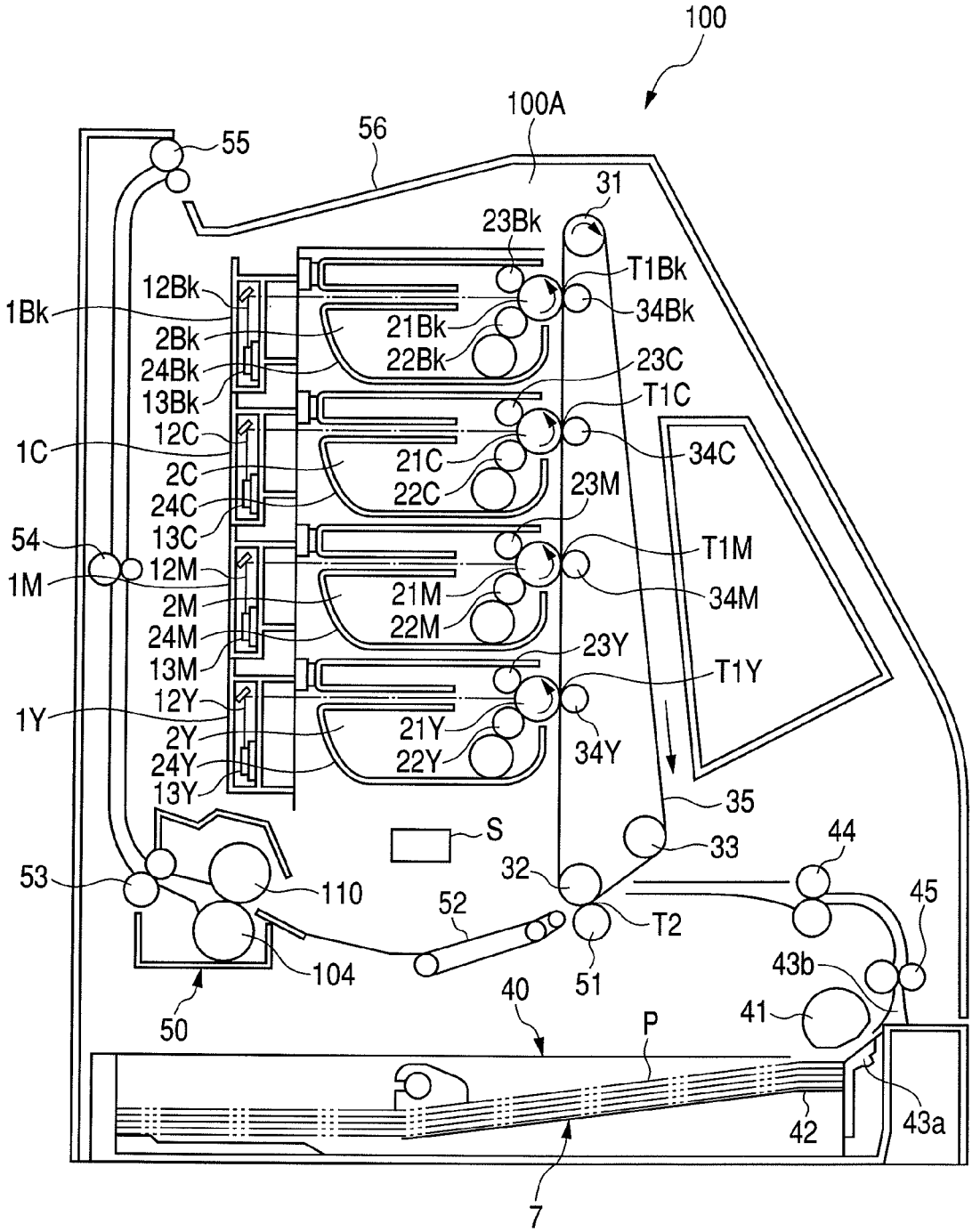
FIG. 1 is a view of an outline configuration in one embodiment of an image forming apparatus according to the present invention.

FIG. 1 is a view illustrating an outline configuration of a color image forming apparatus by way of one embodiment of the image forming apparatus according to the present invention. A color image forming apparatus 100 in the first embodiment is classified as a laser printer, however, the present invention is not limited to such a laser printer.

At first, the whole configuration of the image forming apparatus in the first embodiment will be outlined.

A color laser printer 100 defined as the image forming apparatus in the first embodiment includes four image forming units that form images assuming colors such as Y (yellow), M (magenta), C (cyan) and Bk (black). The image forming units are based on a system of process cartridges 2 (2Y, 2M, 2C and 2Bk). The process cartridges 2 (2Y, 2M, 2C and 2Bk) are detachably attached to an image forming apparatus body 100A.

The process cartridges 2 (2Y, 2M, 2C and 2Bk) have drum-shaped electrophotographic photosensitive members (which will hereinafter be referred to as [photosensitive drums]) 21 (21Y, 21M, 21C and 21Bk) serving as image bearing members that rotate at a fixed speed. In the first embodiment, an intermediate transferring member 35 onto which to transfer a toner image formed by each of the image forming units is disposed in a face-to-face relationship with a photosensitive drum 21. The color image on the intermediate transferring member 35 is further secondarily transferred onto a recording material P fed from a feeding unit 40. The color-image-transferred recording material P is conveyed to a fixing unit (fixing apparatus) 50, in which the color image is fixed onto the recording material P. The image-fixed recording material P is discharged onto a discharge tray 56 provided on an upper surface of the apparatus via a group of discharge rollers 53, 54, 55.

Next, configurations of the respective units of the image forming apparatus will be sequentially described in detail.

Disposed in the peripheries of the image bearing members (photosensitive drums) 21 (21Y, 21M, 21C and 21Bk) are charge rollers 23 (23Y, 23M, 23C and 23Bk) serving as charging means and developing units 24 (24Y, 24M, 24C and 24Bk) that configure developing means. The charge roller 23 and the developing unit 24 are unitized integrally with the photosensitive drum 21, thus building up the process cartridge 2.

As described above, the process cartridges 2 (2Y, 2M, 2C and 2Bk) are supported in an attachable/detachable manner with respect to the apparatus body 100A. The process cartridge 2 can easily be exchanged on a unit basis in accordance with a life-span of the photosensitive drum 21.

In the first embodiment, the photosensitive drum 21 is constructed by coating an organic photoconductive layer serving as an electrophotographic photosensitive material over an external portion of an aluminum cylinder. The photosensitive drum 21 is supported rotatably in a cartridge case member (unillustrated) in which to integrally construct the developing unit 24.

The photosensitive drum 21 is, as illustrated in the drawing, rotated counterclockwise corresponding to an image forming operation by transmitting a driving force of an unillustrated drive motor.

A charging means in the first embodiment is realized by a roller charging method that involves using the charge rollers 23 (23Y, 23M, 23C and 23Bk). A voltage is applied by the charge rollers 23, thereby uniformly charging surfaces of the photosensitive drums 21 with the electricity.

The photosensitive drum 21 is exposed to the light through scanner units 1 (1Y, 1M, 1C and 1Bk) serving as exposing means. When image signals are given to laser diodes, the laser diodes irradiate polygon mirrors 13 (13Y, 13M, 13C and 13Bk) with image beams 12 (12Y, 12M, 12C and 12Bk) corresponding to the image signals. Each polygon mirror 13 is rotated at a high speed by a scanner motor (unillustrated). The surface of the photosensitive drum 21 rotating at the fixed speed is selectively exposed to the image beam 12 reflected from the polygon mirror 13, with the result that an electrostatic latent image is formed on the photosensitive drum 21.

The four process cartridges 2 (2Y, 2M, 2C and 2Bk) include the developing units 24 (24Y, 24M, 24C and 24Bk) serving as the developing means enabling the developments in respective colors such as yellow, magenta cyan and black in order to visualize the latent electrostatic latent images.

The 4-color developing units 24 (24Y, 24M, 24C and 24Bk) include developing sleeves 22 (22Y, 22M, 22C and 22Bk) defined as developing agent bearing members disposed in the face-to-face relationship with the photosensitive drums 21. Each developing sleeve 22 is disposed in such a position as to come into contact with the photosensitive drum 21 while rotating and forms a visible image (toner image) with each color toner on the photosensitive drum 21.

The intermediate transferring member 35 rotates clockwise as viewed in the drawing in a way that synchronizes with an outer periphery speed of the photosensitive drum 21 in order to transfer the toner image on the photosensitive drum 21, which has been visualized by each developing unit 24 when in a color image forming operation. The toner images formed on the photosensitive drums 21 are transferred onto the intermediate transferring member 35 at primary transferring units T1 (T1Y, T1M, T1C and T1Bk) defined as contact points with primary transferring rollers 34 (34Y, 34M, 34C and 34Bk) to which biases are applied. The toner images on the intermediate transferring member 35 are transferred batchwise onto the recording material P by letting the recording material P through between the intermediate transferring member 35 onto which the toner images have been transferred and a secondary transferring roller 51 to which the bias is applied in a secondary transferring unit T2.

In the first embodiment, the intermediate transferring member 35 is constructed of a seamless belt (intermediate transferring belt) looped around three shafts of a drive roller 31, a secondary transferring opposite roller 32 and a tension roller 33. Loads are applied by springs to both ends of the tension roller 33, whereby even when a peripheral length of the intermediate transferring belt 35 changes due to humidity and a temperature within the body or due to a change with a passage of time, a quantity of change can be absorbed.

Guide ribs (unillustrated) are bonded through a bonding agent to an entire periphery of a one-sided edge portion on the inside of the intermediate transferring belt 35. A flange (unillustrated) formed of a resin is disposed with a gradient at a one-sided edge portion of the tension roller 33. The guide ribs (unillustrated) and the flange (unillustrated) regulate a motion in a direction orthogonal to a running direction of the intermediate transferring belt 35.

The intermediate transferring belt 35 is supported with the drive roller 31 serving as a fulcrum on the image forming apparatus body 100A. The driving force of the unillustrated drive motor is transmitted to one end, disposed on the rear side in the drawing, of the drive roller 31, whereby the intermediate transferring belt 35 is rotated clockwise as viewed in the drawing corresponding to the image forming operation.

A sheet feeding unit 40 feeds the recording material P to the image forming portion and includes mainly a cassette 7 stored with plural sheets of recording materials P, a sheet feeding roller 41, a separation pad 42, sheet feeding guide plates 43 (43*a*, 43*b*) and a registration roller pair 44.

When forming the image, the sheet feeding roller 41 is driven to rotate corresponding to the image forming operation, and separates and thus feeds sheet by sheet the recording materials P in the cassette 7. The recording material P is guided by the guide plates 43 and reaches the registration roller pair 44 via a conveyance roller 45. During the image forming operation, the registration roller pair 44 performs in a predetermined sequence a non-rotating operation for letting the recording material P statically stand by and a rotating operation for conveying the recording material P toward the intermediate transferring belt 35. When in a transferring step as a next step, the registration roller pair 44 aligns the image with the recording material P.

The secondary transferring roller 51 is disposed at the secondary transferring unit T2. The bias is applied to the secondary transferring roller 51 in synchronism with the timing for transferring the color images onto the recording material P, and the toner images on the intermediate transferring belt 35 are secondarily transferred onto the recording material P.

In the first embodiment, the recording material P is conveyed by the registration roller pair 44 of the sheet feeding unit 40 at the predetermined speed in the left direction as viewed in the drawing. The recording material P is then conveyed by a conveyance belt 52 toward the fixing apparatus 50 in the next step. Note that the secondary transferring roller 51 has none of the driving force and therefore follows the intermediate transferring belt 35.

Figure 2:
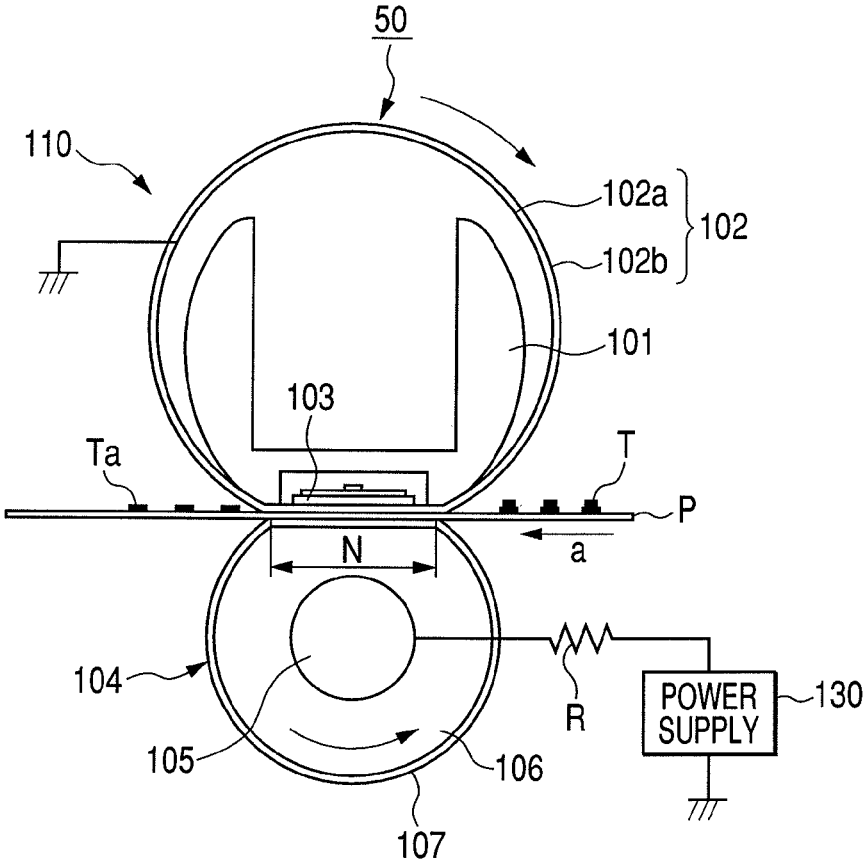
FIG. 2 is a view of an outline configuration in one embodiment of a fixing apparatus according to the present invention.

The fixing apparatus 50 includes, as illustrated in FIG. 2, a heating unit 110 and a nip forming member 104, whereby the toner images (unfixed toner images) formed on the recording material P are fixed by heating. In the first embodiment, the heating unit 110 includes a sleeve guide 101 and a metal sleeve 102 defined as a rotary fixing member, which slides on the sleeve guide 101. The nip forming member 104 forms a fixing nip portion N in combination with the metal sleeve 102, and the recording material P is brought into press-contact with a heater 103 held on the sleeve guide 101. The nip forming member 104 in the first embodiment is constructed as a pressure roller 104 categorized as a rotary member for forming the nip.

The heater (heating source) 103 for heating the recording material P is provided within the sleeve guide 101. To be specific, the recording material P bearing the unfixed toner images is conveyed by the fixing nip portion N formed by the heater 103 and the pressure roller 104 through the metal sleeve 102, and is heated and pressurized. The toner images are thereby fixed onto the recording material P. Thereafter, the recording material P is discharged, with its image surface being directed downward, into a discharge tray 56 provided on an upper portion of the body via a group of discharge rollers 53, 54, 55, thereby finishing the image forming operation.

Next, the fixing apparatus 50 will be described with reference to FIG. 2.

The fixing apparatus 50 in the first embodiment includes, as described above, the metal sleeve 102 as the rotary fixing member in the heating unit 110 and the pressure roller 104 as the rotating nip forming member, i.e. the nip forming rotary member. The fixing nip portion N is formed by bringing the metal sleeve 102 and the pressure roller 104 into press-contact with each other. Note that a surface layer of at least any one of the rotary fixing member and the nip forming member is formed as an insulating layer.

In the first embodiment, the heating unit 110 is constructed of the heater 103, the sleeve guide 101, the metal sleeve 102, etc. The pressure roller 104 is a heat-resistance elastic pressure roller of which the surface is coated with a conductive coating layer 107, wherein a conductive silicon rubber 106 is disposed in the periphery of a cored bar 105.

The metal sleeve 102 is a sleeve having a small heat capacity that enables a quick start. Specifically, the metal sleeve 102 is a metallic sleeve that is 100 μm in thickness and has a base layer 102*a* composed of a single metal or an alloy of metals such as SUS (stainless steel), Al, Ni, Cu and Zn each exhibiting a heat-resistance property and a highly thermal conductivity. For ensuring a mold release characteristic of the toner and a separation characteristic of the recording material, the surface layer 102*b* is coated with a single or a mixture of heat-resistance resins exhibiting a high mold release characteristic and an insulating property, such as a fluororesin and a silicon resin that are exemplified by PTFE (polytetrafluoroethylene), PFA (tetrafluoroethylene-perfluoroalkylviny ether copolymer), EFP (tetrafluoroethylene-hexafluoropropylene copolymer), ETFE (polyethylene-tetrafluoroethylene), CTFE (chloro-trifluoro-ethylene) and PVDF (polyvinylidene difluoride).

The heater 103 for heating is provided within the metal sleeve 102 defined as the fixing sleeve, thereby heating the nip portion N for melting and fixing the toner images on the recording material P.

The sleeve guide 101 is a heat insulation member for holding the heater 103 and preventing a heat emission in the direction opposite to the fixing nip portion N. The sleeve guide 101 is composed of a liquid crystal polymer, a phenol resin, PPS (polyphenylene sulfide) and PEEK (polyether ether ketone). The metal sleeve 102 is loosely fitted with an allowance to the periphery of the sleeve guide 101 and is so disposed as to be rotatable in an arrowhead direction.

The metal sleeve 102 rotates while sliding on the heater 103 and the sleeve guide 101 provided inside and therefore needs to restrain a friction resistance down to a small level between the heater 103, the sleeve guide 101 and the metal sleeve 102. Hence, a small amount of lubricant such as a heat-resistance grease is applied to the surface of the heater 103 and the surface of the sleeve guide 101. The metal sleeve 102 can be thereby rotated smoothly.

The heating unit 110 is sufficiently pressurized toward the pressure roller 104 in order to form the fixing nip portion N necessary for heat-fixation from both of the ends in a longitudinal direction. The heating unit 110 is pressurized toward the pressure roller 104 by a pressure means (unillustrated) such as a spring via part of the sleeve guide 101 or a member secured by fitting to the sleeve guide 101.

The pressure roller 104 is driven to rotate by a drive gear (unillustrated) secured to an edge portion of the cored bar 105. The metal sleeve 102 is follow-rotated at a predetermined speed by a friction between the surface of the pressure roller 104 and the surface of the metal sleeve 102.

Figure 3:
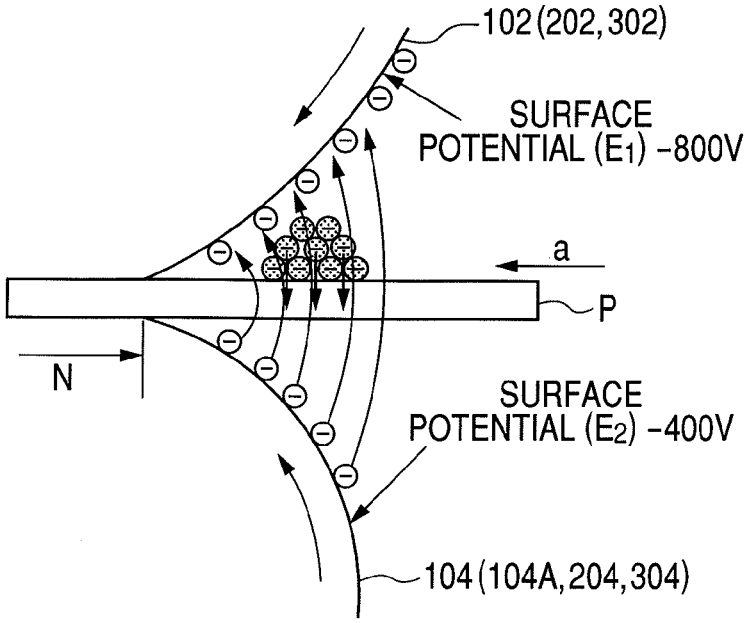
FIG. 3 is an explanatory view of a potential relationship when applying a bias in the fixing apparatus according to the present invention.

Next, as a feature of the first embodiment, bias applying timing of the bias applying means (power supply) will be described in detail with reference to FIGS. 2, 3 and 4.

A scheme in the first embodiment is that a power supply 130 defined as the bias applying means is pressed against the cored bar 105 of the pressure roller 104 via a resistance R and a carbon chip (unillustrated), whereby the bias having the same polarity as the toner has can be applied. As to the bias to be applied, FIG. 4 illustrates applied voltages (V1, V2) to the pressure roller 104, a surface potential (E2) of the pressure roller and a surface potential (E1) of the fixing metal sleeve with respect to a positional relationship between the fixing nip and the recording material. In FIG. 4, t1 represents timing when the recording material is inserted in the fixing nip, t2 denotes timing when the recording material gets separated from the fixing nip, and t3 stands for timing when the next recording material is inserted in the fixing nip. As shown in FIG. 4, a changeover occurs before the recording material P reaches the fixing nip portion N and in the middle of passing through the fixing nip portion N.

To start with, before a leading edge of the recording material P reaches the fixing nip portion N, the voltage (the first vias V1) having the same polarity as the toner has is applied to the pressure roller 104. In the first embodiment, the toner has the negative polarity, and hence the voltage V1 is set at, e.g., minus 2 kV that is equal to or larger than a discharge starting voltage with respect to the metal sleeve 102. At that time, the surface layer of the pressure roller 104 is composed of the conductive rubber 106 and the conductive coating layer 107, and therefore the surface potential (the surface potential E2) of the pressure roller 104 is equalized to the voltage (the first bias V1) applied to the pressure roller 104. Namely, in the first embodiment, the surface potential (the surface potential E2) of the pressure roller 104 gets charged at minus 2 kV that is approximately equal to the voltage 1 of the pressure roller 104.

Before applying minus 2 kV to the pressure roller 104, the surface of the metal sleeve 102 is friction-charged at minus 200 V or thereabouts. If the surface of the pressure roller 104 is charged at minus 2 kV that is equal to or larger than the discharge starting voltage with respect to the metal sleeve 102, however, the discharge gets started between the surface of the metal sleeve 102 and the surface of the pressure roller 104, thereby charging the surface of the metal sleeve 102 with the electricity. A charge potential of the surface of the metal sleeve 102 is on the order of, e.g., minus 800 V.

Namely, before the recording material P reaches the fixing nip portion N, an entire area of the metal sleeve 102 in a circumferential direction gets discharged, whereby the surface potential (the surface potential E1) of the metal sleeve 102 comes to a state of being charged at minus 800 V over the entire surface (the entire periphery). In the first embodiment, a recording material conveying speed (a peripheral speed of the pressure roller 104) is on the order of 240 m/s, and a peripheral length of the metal sleeve 102 is 76 mm. It is therefore feasible to charge the entire periphery of the metal sleeve 102 with the electricity for a period of time, i.e., 0.3 sec or a bit longer. As described above, before the leading edge of the recording material P enters the fixing nip portion N, the power supply 130 applies, to the nip forming member (pressure roller) 104, the first voltage V1 that has the same polarity as the toner charging polarity and is equal to or larger than the discharge starting voltage to the rotary fixing member (metal sleeve) 102 from the nip forming member (pressure roller) 104. The surface of the rotary fixing member is thereby charged at the same polarity as the toner charging polarity.

Just before the recording material P reaches the fixing nip portion N, according to the first embodiment, the voltage applied to the pressure roller 104 is changed over at an anterior point of 10 mm. The post-changeover voltage (second bias V2) is set at, e.g., minus 400 V. At this time, the pressure roller 104 is composed of the conductive rubber 106 and the conductive coating layer 107, and hence the surface potential E2 of the pressure roller 104 is instantaneously changed over to minus 400 V that is approximately equal to the applied bias. This voltage is smaller than the discharge starting voltage with respect to the metal sleeve 102, with the result that the discharge does not occur. The surface of the metal sleeve 102 is an insulating surface layer 102*b*, so that the surface potential E1 is kept at an as-charged potential of minus 800 V. Thus, while the recording material P passes through the fixing nip portion N, the power supply 130 applies, to the nip forming member (pressure roller) 104, the second voltage V2 having the same polarity as the toner charging polarity and of which an absolute value is smaller than the first voltage V1.

As described above, the absolute value of the surface potential E1 of the metal sleeve 102 and the absolute value of the surface potential E2 of the pressure roller 104 have a relationship such as E1<E2 before the recording material P reaches the fixing nip portion N, and have a relationship such as E1>E2 during a period when the recording material P is conveyed by the fixing nip portion N.

The potential relationship given above shows such a state that the surface of the pressure roller 104 is, e.g., minus 400 V, the surface of the metal sleeve 102 is, e.g., minus 800 V, and an electric field thereof occurs toward the pressure roller 104 from the metal sleeve 102. In this state of the electric field, when conveying the recording material P, the toners on the recording material P undergo repulsion from the surface layer 102*b* of the metal sleeve 102 and are further attracted toward the pressure roller 104 due to the electric field, and hence there is a high effect in offset (see FIG. 3).

Note that the values given above are the optimum values in the first embodiment and have the greatest effect in the offset, however, the optimum values are changeable depending on the environment, the type of the recording material and the configurations of the metal sleeve 102 and of the pressure roller 104. If the toner charging polarity is opposite to the polarity in the embodiment, the polarity of the value given above may be set opposite to the polarity in the embodiment.

The first embodiment has exemplified the metallic sleeve (metal sleeve) 102 as the rotary fixing member. The rotary fixing member can, however, involve using a fixing apparatus as a substitute for the metal sleeve 102, which employs a fixing film defined as a resin film having the heat-resistance property. The fixing film can take a 3-layered structure including a polyimide layer that is 50 μm in thickness, a conductive bonding layer having a thickness of several μm, which is stacked on the polyimide layer, and a fluororesin layer as a top layer having a thickness of several μm.

Figure 5:
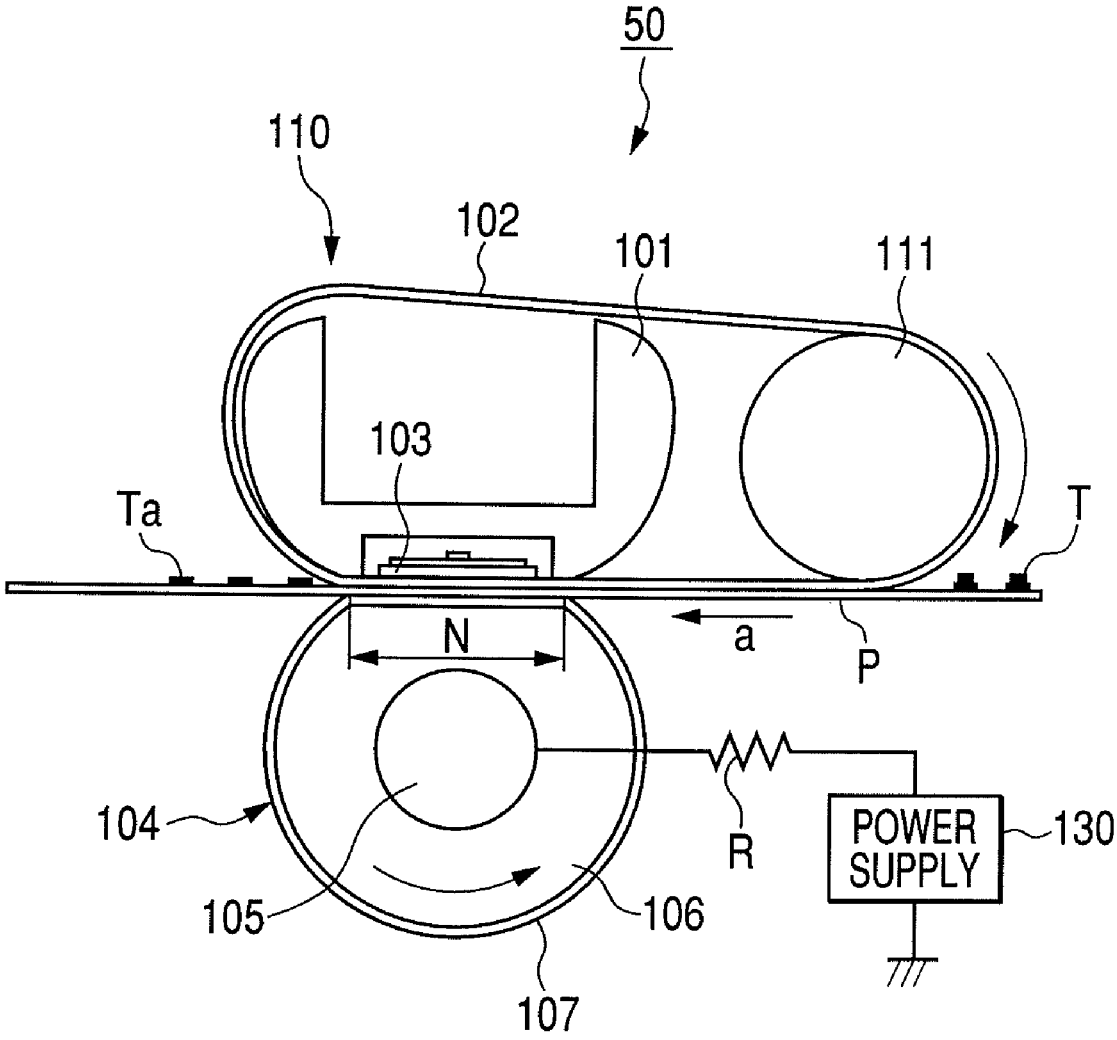
FIG. 5 is a view of an outline configuration in another embodiment of the fixing apparatus according to the present invention.

The present invention can be further applied to the fixing apparatus as illustrated in FIG. 5. Namely, the heating unit 110 can take a configuration including a sleeve guide 101 having the heater 103 and including the roller 111, wherein an endless belt 102 serving as a movable rotary member is stretched between the sleeve guide 101 and the roller 111. As a matter of course, the endless belt 102 may be a metallic fixing belt and may also be a resinous fixing film.

The first embodiment having the configuration described above has the following effects.

A first effect is that the offset can be prevented by keeping the potential relationship given above during the conveyance of the recording material P.

A second effect is that the surface potential of the pressure roller (nip forming member) 104 and the surface potential of the rotary fixing member (the metal sleeve, the resinous fixing film and the endless belt) 102 can be controlled with high accuracy, and hence the offset can be prevented invariably with stability in a way that gets flexible to the type of the recording material P and a change in the environment.

A third effect is that the effects given above are attained by one single power supply 130, whereby a rise in costs can be restrained.

Second Embodiment

Next, a second embodiment of the present invention will be described. The basic configurations of the image forming apparatus 100 and the fixing apparatus 50 according to the second embodiment are the same as those in the first embodiment discussed with reference to FIGS. 1 and 2. Accordingly, the descriptions of the image forming apparatus 100 and the fixing apparatus 50 involve quoting the descriptions in the first embodiment, and the discussion herein will be focused on constructive portions characteristic of the second embodiment.

In the case of performing the control exemplified in the first embodiment, there occurs a phenomenon that the absolute value of the surface potential of the metal sleeve 102 decreases stepwise due to the potential of the recording material P, the environment and the toner charging quantity during the conveyance of the recording material P.

For example, as to the surface potential E1 of the metal sleeve 102, the surface potential of minus 800 V decreases down to about minus 600 V after the A4-size recording material has passed. Therefore, when consecutively printed, if the number of pass-through sheets increases, such a problem arises that the offset can not be prevented.

The characteristic of the second embodiment resides in the bias applying control in the case of consecutively letting the sheets pass through.

Figure 4:
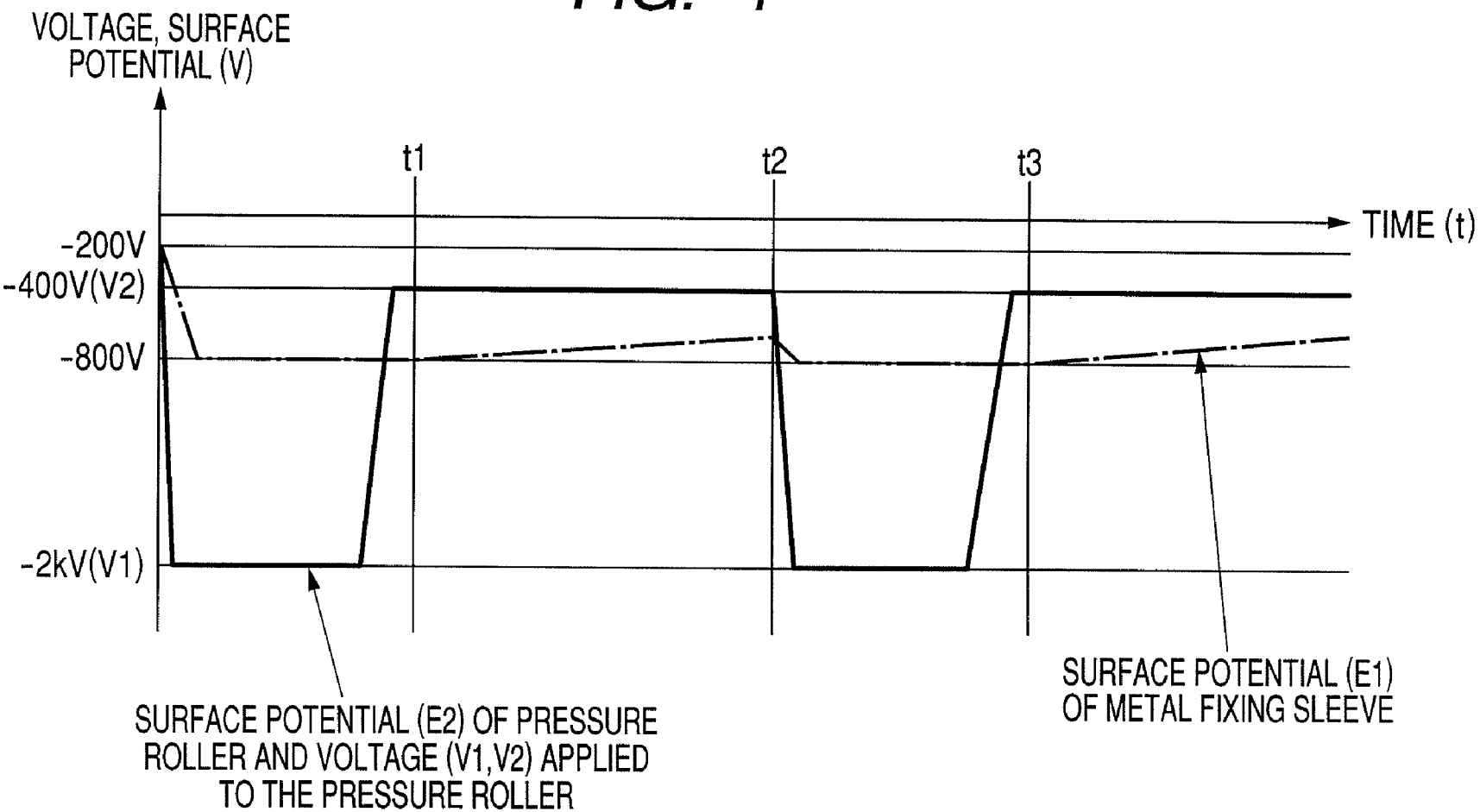
FIG. 4 is an explanatory timing chart showing a bias applying mode and the potential relationship in the fixing apparatus according to the present invention.

According to the second embodiment, a solution of the problem given above is the control of changing over, as illustrated in FIG. 4, the second bias V2 applied to the pressure roller 104 to the first bias V1 before the recording material P reaches the fixing nip portion N between the recording material P under the conveyance and a next recording material P. The voltage V1 after the changeover is, e.g., minus 2 kV that is equal to or larger than the discharge starting voltage with respect to the metal sleeve 102.

As stated in the first embodiment, the entire periphery of the metal sleeve 102 can be charged with the electricity for 0.3 sec or a bit longer, and hence the controllability can be attained if an interval between the in-process recording material and the next recording material is set equal to or larger than 76 mm. The scheme in the second embodiment is that the interval is set to 90 mm in consideration of the applied bias changeover timing and a margin. As a result, the always-stable potential relationship can be kept even when consecutively printed, which invariably exhibits the effect in preventing the offset.

Owing to the configuration described above, in addition to the effects in the first embodiment, there is the effect in stably preventing the offset even when consecutively letting the sheets pass through.

Third Embodiment

Next, a third embodiment of the present invention will be discussed. The basic configurations of the image forming apparatus 100 and the fixing apparatus 50 according to the third embodiment are the same as those in the first embodiment discussed with reference to FIGS. 1 and 2. Accordingly, the descriptions of the image forming apparatus 100 and the fixing apparatus 50 involve quoting the descriptions in the first embodiment, and the discussion herein will be focused on constructive portions characteristic of the third embodiment.

The case of performing the control described in the first and second embodiments has proven that the offset occurs if the environment for installing the apparatus is changed.

The third embodiment will exemplify an example in which a sensor (hereinafter referred to as "environment sensor") S (see FIG. 1) for detecting a temperature and humidity in the basic configuration of the image forming apparatus described in the first embodiment, and the optimum bias is applied to the pressure roller 104 on the basis of the environmental setting detected by the environment sensor S.

Figure 6:
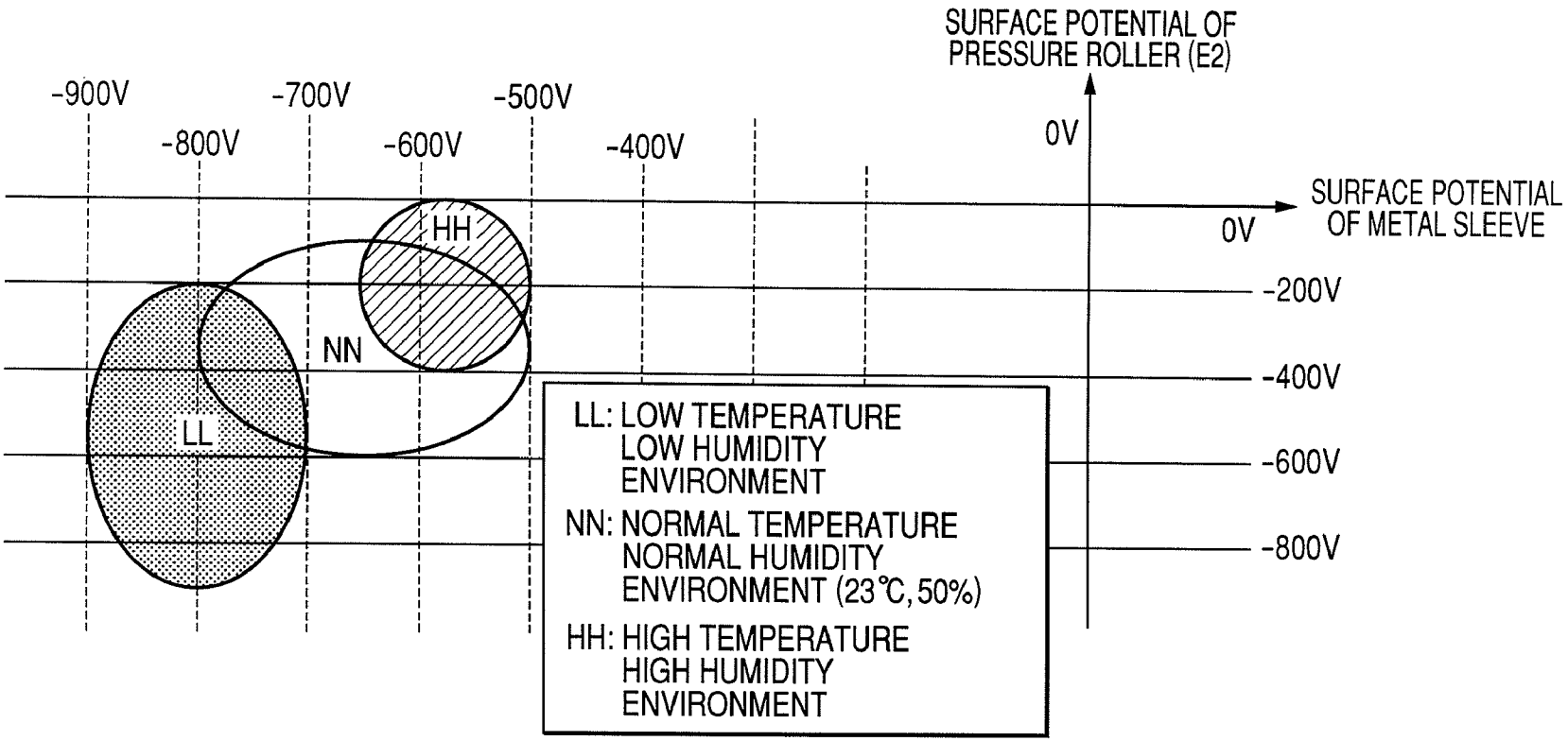
FIG. 6 is an explanatory view showing how the bias is applied corresponding to a fluctuation in environment in the fixing apparatus.

The environment sensor S detects the temperature and the humidity and classifies the environment into three categories such as a high-temperature/high-humidity environment, a normal-temperature/normal-humidity environment and a low-temperature/low-humidity environment on the basis of values of the detected temperature and humidity and an empirically-acquired database. An optimum value of the bias applied to the pressure roller 104 is determined from a result thereof. The optimum applied bias in the third embodiment becomes as shown in FIG. 6. FIG. 6 shows a relationship between the surface potential of the metal sleeve and the surface potential of the pressure roller. In FIG. 6, an area designated by LL represents the low-temperature/low-humidity environment, an area NN denotes the normal-temperature/normal-humidity environment, and an area HH represents the high-temperature/high-humidity environment.

When the environment sensor S determines the environment to be the high-temperature/high-humidity environment, before the recording material P reaches the fixing nip portion N, the voltage (the first bias V1) having the same polarity as the toner polarity is applied to the pressure roller 104. The applied voltage V1 is, e.g., minus 1.5 kV that is equal to or larger than the discharge starting voltage. Along with this bias applied, in the same way as by the first embodiment, the surface of the metal sleeve 102 is charged with the electricity. The charge potential (the surface potential E1) is on the order of, e.g., minus 500 V through minus 650 V.

Just before the recording material P reaches the fixing nip portion N, according to the third embodiment, the voltage applied to the pressure roller 104 is changed over at an anterior point of 10 mm to the second bias V2, e.g., a voltage ranging from 0 V (or the earth voltage) to minus 400 V. At this time, the pressure roller 104 is, as illustrated in FIG. 2, composed of the conductive rubber 106 and the conductive coating layer 107, and hence the surface potential E2 of the pressure roller 104 is instantaneously changed over to the surface potential that is equal to the applied bias. This voltage is smaller than the discharge starting voltage with respect to the metal sleeve 102, with the result that the discharge does not occur. The surface of the metal sleeve 102 is the insulating surface layer 102*b*, so that the potential ranging from as-charged minus 500 V to minus 650 V is maintained. The potential relationship described above shows the optimum value for restraining the occurrence of the offset in the high-temperature/high-humidity environment.

When the environment sensor S determines the environment to be the normal-temperature/normal-humidity environment, before the recording material P reaches the fixing nip portion N, the voltage (the first bias V1) having the same polarity as the toner polarity is applied to the pressure roller 104. The applied voltage V1 is, e.g., minus 2 kV that is equal to or larger than the discharge starting voltage. Along with this bias applied, in the same way as by the first embodiment, the surface of the metal sleeve 102 is charged with the electricity. The charge potential (the surface potential E1) is on the order of, e.g., minus 500 V through minus 800 V.

Just before the recording material P reaches the fixing nip portion N, according to the third embodiment, the voltage applied to the pressure roller 104 is changed over at the anterior point of 10 mm to the second bias V2, e.g., a voltage ranging from minus 100 V to minus 600 V. At this time, the pressure roller 104 is composed of the conductive rubber and the conductive surface layer, and therefore the surface potential E2 of the pressure roller 104 is instantaneously changed over to the surface potential that is equal to the applied bias. This voltage is smaller than the discharge starting voltage with respect to the metal sleeve 102, with the result that the discharge does not occur. The surface of the metal sleeve 102 is the insulating surface layer 102*b*, so that the potential ranging from as-charged minus 500 V to minus 800 V is maintained. The potential relationship described above shows the optimum value for restraining the occurrence of the offset in the normal-temperature/normal-humidity environment.

When the environment sensor S determines the environment to be the low-temperature/low-humidity environment, before the recording material P reaches the fixing nip portion N, the voltage (the first bias V1) having the same polarity as the toner polarity is applied. The applied voltage V1 is, e.g., minus 2.2 kV that is equal to or larger than the discharge starting voltage. Along with this bias applied, in the same way as by the first embodiment, the surface of the metal sleeve 102 is charged with the electricity. The charge potential (the surface potential E1) is on the order of, e.g., minus 700 V through minus 900 V.

Just before the recording material P reaches the fixing nip portion N, according to the third embodiment, the voltage applied to the pressure roller 104 is changed over at the anterior point of 10 mm to the second bias V2, e.g., a voltage ranging from minus 200 V to minus 900 V. At this time, the pressure roller 104 is composed of the conductive rubber 106 and the conductive surface layer 107, and hence the surface potential E2 of the pressure roller 104 is instantaneously changed over to the surface potential that is equal to the applied bias. This voltage is smaller than the discharge starting voltage with respect to the metal sleeve 102, with the result that the discharge does not occur. The surface of the metal sleeve 102 is the insulating surface layer 102*b*, so that the potential ranging from as-charged minus 700 V to minus 900 V is maintained. The potential relationship described above shows the optimum value for restraining the occurrence of the offset in the low-temperature/low-humidity environment.

In the third embodiment, the scheme of classifying the environment into the three categories has proven that there is the effect in preventing the offset if the environment difference exists. The environment can be, however, classified into more of the plural categories than the above. In this case, the much finer bias control can be attained, and therefore the higher effect in preventing the offset can be expected.

With the scheme described above, i.e., the scheme of correcting the first bias V1 and the second bias V2 corresponding to the environmental fluctuations, in addition to the effects in the first embodiment and the second embodiment, there is the effect in stably preventing the offset under whatever environment.

Fourth Embodiment

Next, a fourth embodiment of the present invention will be discussed. The basic configuration of the image forming apparatus 100 according to the fourth embodiment is the same as in the first embodiment discussed with reference to FIG. 1. Accordingly, the description of the image forming apparatus 100 involves quoting the description in the first embodiment.

Figure 7A:
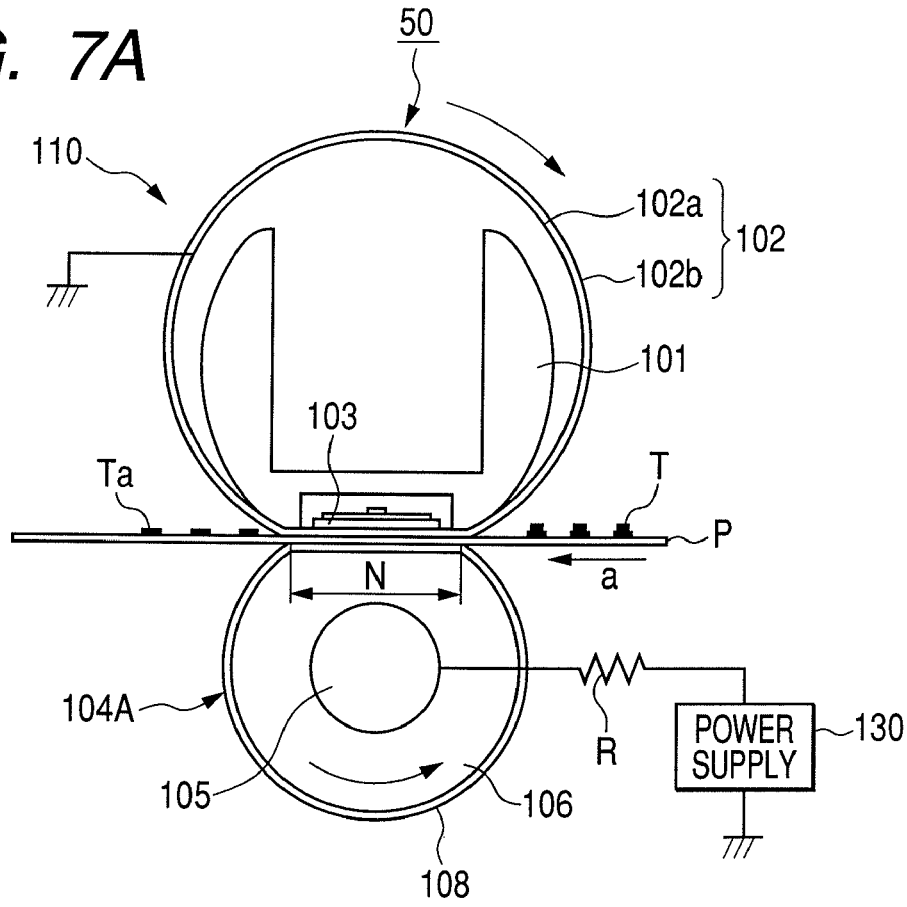
FIGS. 7A and 7B are views each showing an outline configuration in still another embodiment of the fixing apparatus according to the present invention.

The basic configuration of the fixing apparatus 50 in the fourth embodiment is, as illustrated in FIG. 7A, the same as in the first embodiment described with reference to FIG. 1. A different point is, however, such that the pressure roller 104A is constructed as a heat-resistance elastic pressure roller of which the surface layer is an insulation-coated layer 108. Accordingly, the members having the same constructions and the same functions as those in the first embodiment are marked with the same reference numerals, and the descriptions thereof in the first embodiment are quoted. The discussion herein will be focused on the constructive portions characteristic of the fourth embodiment.

Figure 8:
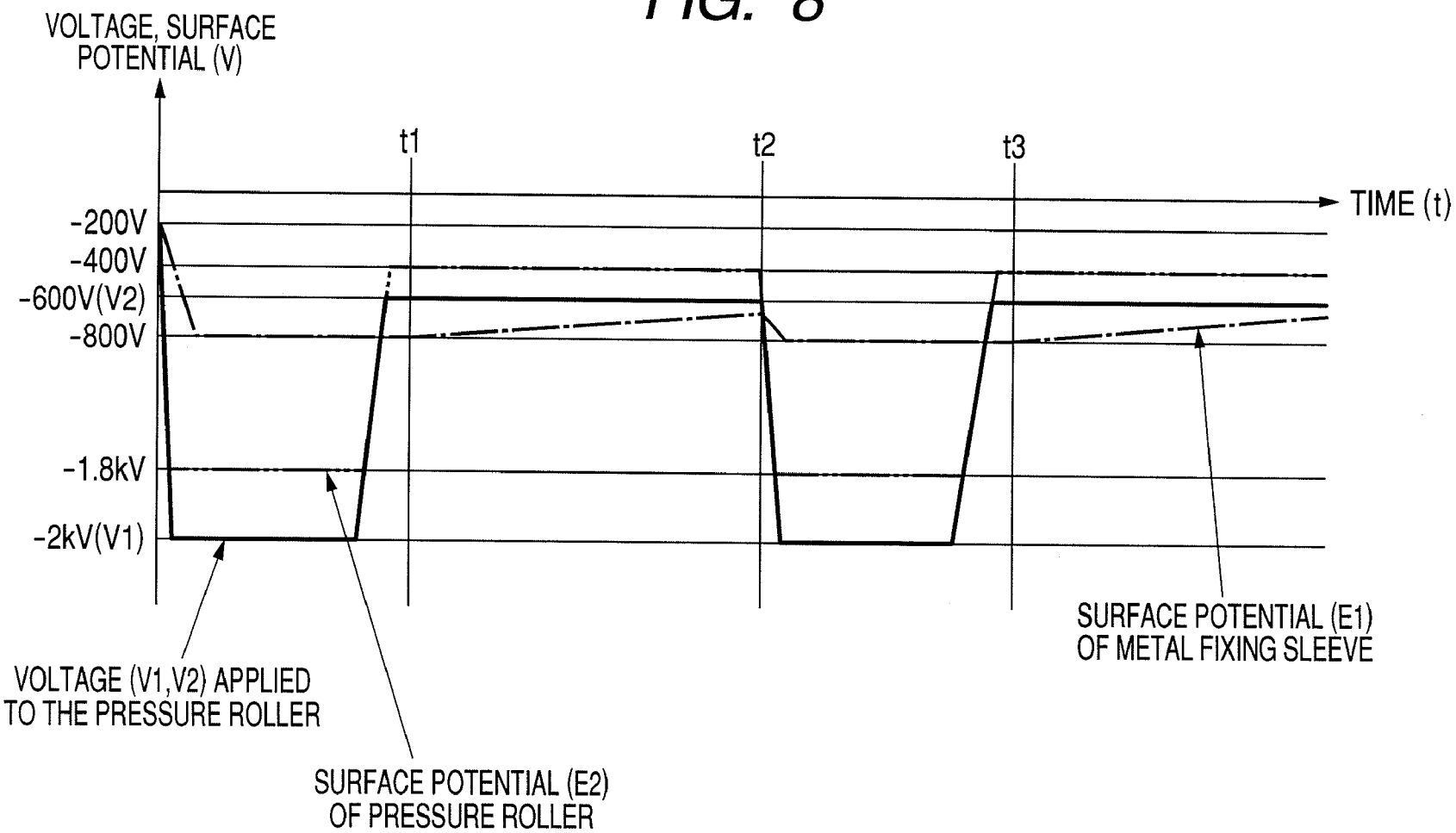
FIG. 8 is an explanatory timing chart showing the bias applying mode and the potential relationship in the fixing apparatus according to the present invention.

The bias applied to the fixing apparatus and the applying timing thereof, which are characteristic of the fourth embodiment, will be described in detail, with reference to FIGS. 7A, 8 and 3.

A scheme in the fourth embodiment is that the power supply 130 is pressed via the resistance R and the carbon chip (unillustrated) against the cored bar 105 of the pressure roller 104A, and the bias having the same polarity as the toner polarity can be applied. The bias to be applied is changed over, as shown in FIG. 8, before the recording material P reaches the fixing nip portion N and in the process of the recording material P passing therethrough. FIG. 8 is a diagram showing the applied voltages (V1, V2) to the pressure roller 104A, the surface potential (E2) of the pressure roller and the surface potential (E1) of the fixing metal sleeve with respect to a positional relationship between the fixing nip and the recording material. In FIG. 8, t1 represents timing when the recording material is inserted in the fixing nip, t2 denotes timing when the recording material gets separated from the fixing nip, and t3 stands for timing when the next recording material is inserted in the fixing nip.

To start with, before the recording material P reaches the fixing nip portion N, the voltage (the first vias V1) having the same polarity as the toner polarity is applied. The voltage V1 is set at, e.g., minus 2 kV. Before applying the bias, the surface of the pressure roller 104A is charged at, e.g., plus 200 V due to a frictional charge and a counter charge with the surface of the metal sleeve 102. Hence, after applying the bias, the surface potential E2 of the pressure roller 104A is charged at minus 1.8 kV. Depending on the changeover timing of the surface potential and if the applied bias has a low absolute value, however, the level is the same as the applied voltage.

Before applying the bias, the surface of the metal sleeve 102 is charged normally at minus 200 V or thereabouts due to the frictional charge described above. When the surface of the pressure roller 104A is charged at minus 1.8 kV, the discharge gets started with respect to the surface of the metal sleeve 102, and the surface potential (the surface potential E1) of the metal sleeve 102 is charged at, e.g., minus 800 V. Before the recording material reaches the fixing nip portion N, the discharge is made to occur over the entire area of the metal sleeve 102 in the peripheral direction, whereby the whole surface of the metal sleeve 102 comes to a state of being charged at minus 800V. In the fourth embodiment, the recording material conveying speed (the peripheral speed of the pressure roller 104A) is on the order of 240 mm/s, and the peripheral length of the metal sleeve 102 is 76 mm. Therefore, the entire periphery of the metal sleeve 102 can be charged for 0.3 sec or a bit longer.

Just before the recording material P reaches the fixing nip portion N, according to the fourth embodiment, the voltage applied to the pressure roller 104A is changed over at the anterior point of 10 mm to the second bias V2. The post-changeover voltage V2 is set at, e.g., minus 600 V. At this time, the pressure roller 104A is composed of the conductive rubber 106 and the insulation-coated layer 108, and is affected by the frictional charge. Hence, the surface potential E2 of the pressure roller 104A is changed over to minus 400V. This voltage is smaller than the discharge starting voltage with respect to the metal sleeve 102, with the result that the discharge does not occur. The surface of the metal sleeve 102 is the insulating surface layer 102*b*, so that the as-charged potential of minus 800 V is kept.

The potential relationship given above is that the surface of the pressure roller 104A is, e.g., minus 400 V, the surface of the metal sleeve 102 is, e.g., minus 800 V, and the electric field thereof occurs toward the pressure roller 104A from the metal sleeve 102. In this state, when conveying the recording material P, the toners on the recording material P undergo the repulsion from the surface layer of the metal sleeve 102 and are further attracted toward the pressure roller 104A due to the electric field, and hence there is the high effect in the offset (see FIG. 3).

Figure 7B:
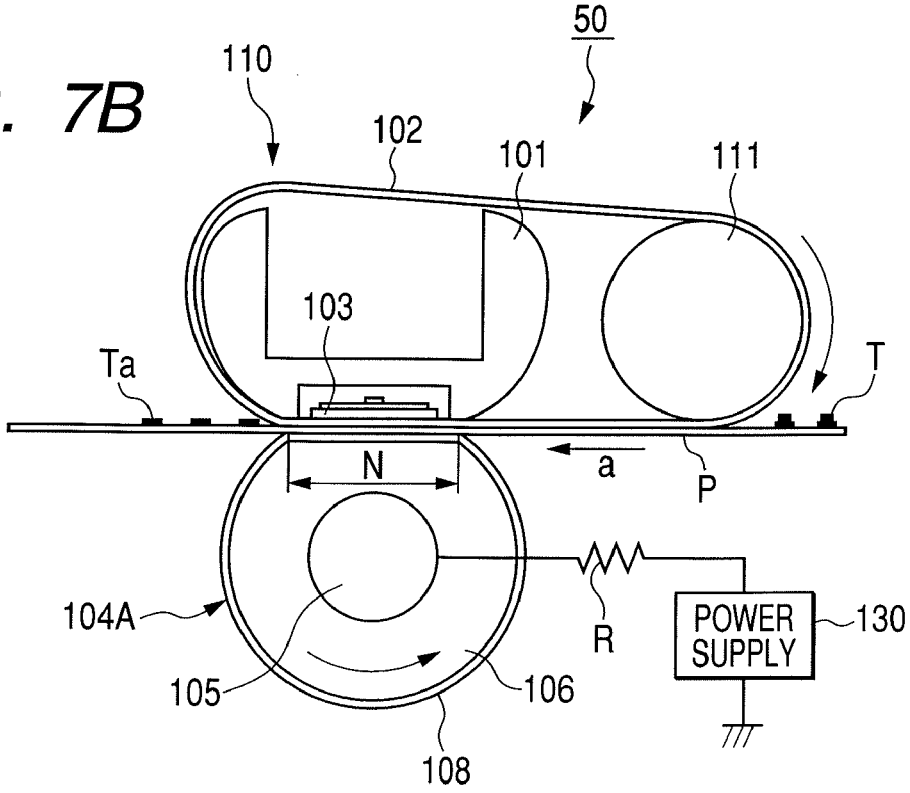

Note that the basic configuration of the fixing apparatus 50 illustrated in FIG. 7B is the same as in the first embodiment described with reference to FIG. 5. A different point is, however, such that the pressure roller 104A is constructed as a heat-resistance elastic pressure roller of which the surface layer is the insulation-coated layer 108. Accordingly, the members having the same constructions and the same functions as those in the first embodiment are marked with the same reference numerals, and the descriptions thereof in the first embodiment are quoted.

The configuration described above has the following effects.

A first effect is that the offset can be prevented by keeping the potential relationship given above during the conveyance of the recording material P.

A second effect is that the surface potential of the pressure roller (nip forming member) 104A and the surface potential of the metal sleeve (the rotary fixing member) 102 can be controlled with the high accuracy, and hence the offset can be prevented invariably with stability in a way that gets flexible to the type of the recording material P and a change in the environment.

A third effect is that the effects given above are attained by one single power supply, whereby a rise in costs can be restrained.

In the same way as by the second embodiment, according to the fourth embodiment, after conveying the recording material, during an interval till the next recording material reaches the fixing nip portion N, the control of changing over the bias to be applied is conducted. As a result, substantially the same effect as in the second embodiment can be obtained.

In the same way as by the third embodiment, according to the fourth embodiment, the environment sensor S detects the environment. The applied bias is controlled based on a result of the detection thereof. As a consequence, substantially the same effects as in the third embodiment can be acquired.

Fifth Embodiment

A fifth embodiment will be next described. The basic configuration of the image forming apparatus 100 in the fifth embodiment is the same as in the first embodiment discussed with reference to FIG. 1. Accordingly, the description of the image forming apparatus 100 involves quoting the description in the first embodiment.

Figure 9:
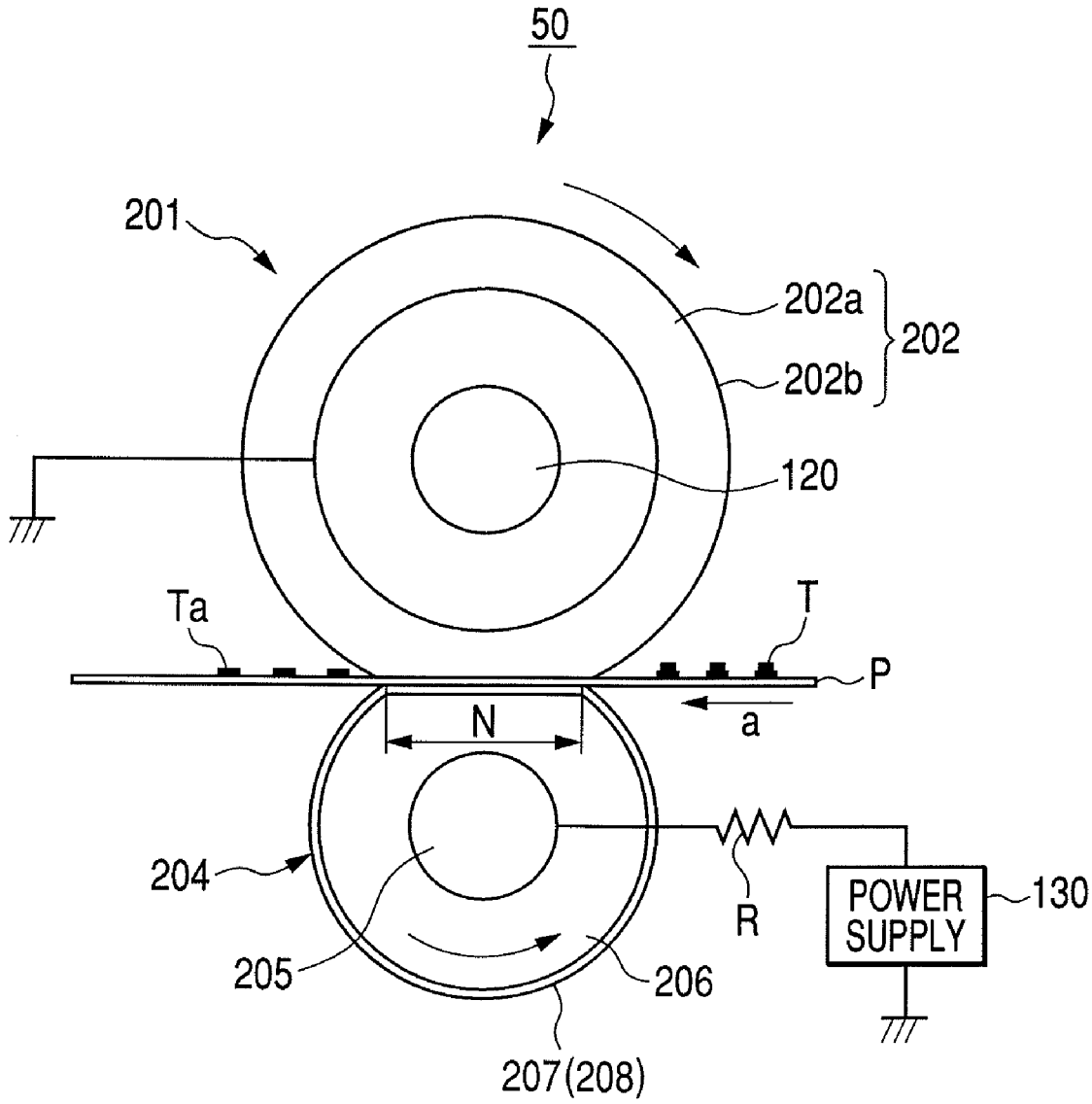
FIG. 9 is a view of an outline configuration in yet another embodiment of the fixing apparatus according to the present invention.

The fixing apparatus 50 in the fifth embodiment, however, takes the configuration illustrated in FIG. 9.

Referring to FIG. 9, the fixing apparatus 50 in the fifth embodiment includes a fixing roller 202 defined as a rotary member and a pressure roller 204 serving as a nip forming member. The fixing roller 202 and the pressure roller 204 are brought into the press-contact with each other, thereby forming the fixing nip portion N.

The fixing roller 202 includes an insulating surface layer 202*b* constructed by coating a fluororesin such as PFA (tetrafluoroethylene-perfluoroalkylvinyl ether copolymer) having a thickness of approximately 30 μm over an aluminum cylinder 202*a* that is 25 mm in outer diameter and 2 mm in wall thickness. A halogen heater 120 serving as a heating member is disposed inside the fixing roller 202. The halogen heater 120 heats up the fixing roller 202 so that a temperature thereof becomes an appropriate temperature under predetermined control.

The pressure roller 204 is a heat-resistance elastic pressure roller including a cored bar 205, a conductive silicon rubber 206 formed around the cored bar 205 and a conductive coated layer 207 coated over the surface of the conductive silicon rubber 206. The pressure roller 204 is sufficiently pressurized toward the fixing roller 202 in order to form the fixing nip portion N necessary for heat-fixation from both of the ends in a longitudinal direction by a pressure means (unillustrated) such as a spring. The fixing roller 202 is driven to rotate by a drive gear (unillustrated) secured to an edge portion of the cored bar, whereby the pressure roller 204 is follow-rotated at a predetermined speed by dint of a friction between the surface of the pressure roller 204 and the surface of the fixing roller 202.

Figure 10:
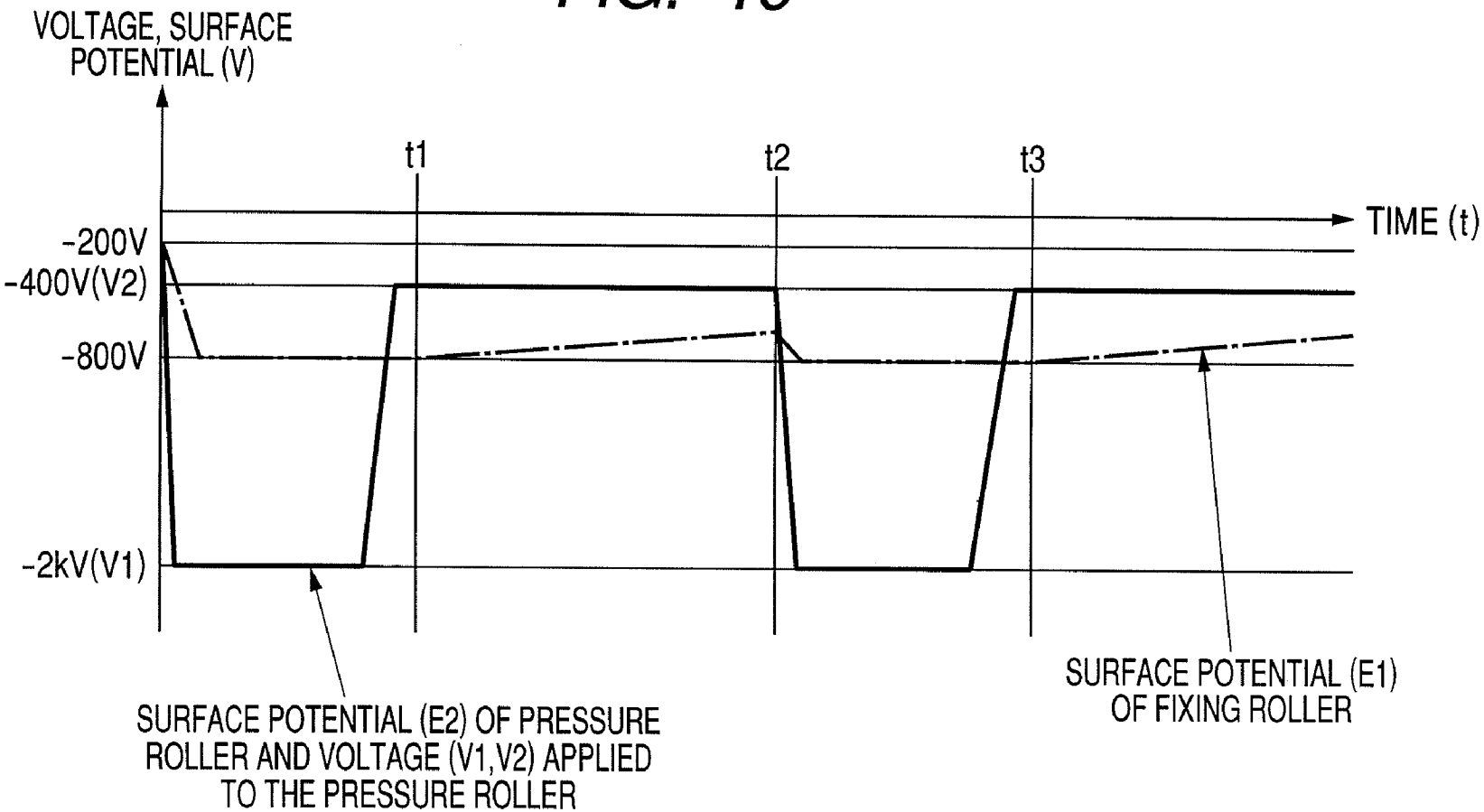
FIG. 10 is an explanatory timing chart showing the bias applying mode and the potential relationship in the fixing apparatus according to the present invention.

The power supply 130 is pressed against the cored bar 205 of the pressure roller 204 via the resistance R and the carbon chip (unillustrated), whereby the bias having the same polarity as the toner has can be applied. The bias to be applied is, as illustrated in FIG. 10, changed over before the recording material P reaches the fixing nip portion N and in the process of the recording material P passing therethrough. FIG. 10 is a diagram showing the applied voltages (V1, V2) to the pressure roller, the surface potential (E2) of the pressure roller and the surface potential (E1) of the fixing roller with respect to a positional relationship between the fixing nip and the recording material. In FIG. 10, t1 represents the timing when the recording material is inserted in the fixing nip, t2 denotes the timing when the recording material gets separated from the fixing nip, and t3 stands for the timing when the next recording material is inserted in the fixing nip.

To begin with, before the recording material P reaches the fixing nip portion N, the voltage (the first vias V1) having the same polarity as the toner polarity is applied. The voltage is set at, e.g., minus 2 kV. At this time, the surface layer of the pressure roller 204 is composed of the conductive rubber 206 and the conductive surface layer 207, and hence the surface potential E2 of the pressure roller 204 is equalized to the voltage applied to the pressure roller 204. Namely, according to the fifth embodiment, the surface potential E2 of the pressure roller 204 is charged at minus 2 kV that is approximately the same as the voltage V1 of the pressure roller 204.

Before applying the bias, the surface of the fixing roller 202 is charged at minus 200 V or thereabouts. When the surface of the pressure roller 204 is charged at minus 2 kV, the discharge gets started with respect to the surface of the fixing roller 202, and the surface of the fixing roller 202 is charged. The charge potential is for example, minus 800V. Before the recording material P reaches the fixing nip portion N, the discharge is made to occur over the entire area of the fixing roller 202 in the peripheral direction, whereby the entire surface (the surface potential E1) of the fixing roller 202 comes to a state of being charged at minus 800 V. In the fifth embodiment, the recording material conveying speed (the peripheral speed of the pressure roller 204) is on the order of 240 mm/s, and the peripheral length of the fixing roller 202 is 78.5 mm. Therefore, the entire periphery of the fixing roller 202 can be charged for a period of 0.3 sec or a bit longer.

Just before the recording material P reaches the fixing nip portion N, according to the fifth embodiment, the voltage applied to the pressure roller 204 is changed over to the second vias V2 at an anterior point of 10 mm. The post-changeover voltage V2 is set at, e.g., minus 400 V. At this time, the pressure roller 204 is composed of the conductive rubber and the conductive surface layer, and hence the surface potential E2 of the pressure roller 204 is instantaneously changed over to minus 400 V that is approximately equal to the applied bias. This voltage is smaller than the discharge starting voltage with respect to the fixing roller 202, with the result that the discharge does not occur. The surface of the fixing roller 202 is an insulating surface layer, so that the surface potential E1 is kept at an as-charged potential of minus 800 V.

The potential relationship given above is that the surface (the surface potential E2) of the pressure roller 204 is, e.g., minus 400 V, the surface (the surface potential E1) of the fixing roller 202 is, e.g., minus 800 V, and the electric field thereof occurs toward the pressure roller 204 from the fixing roller 202. In this state, when conveying the recording material P, the toners on the recording material P undergo the repulsion from the surface layer of the fixing roller 202 and are further attracted toward the pressure roller 204 due to the electric field, and hence there is the high effect in the offset (see FIG. 3).

Figure 11:
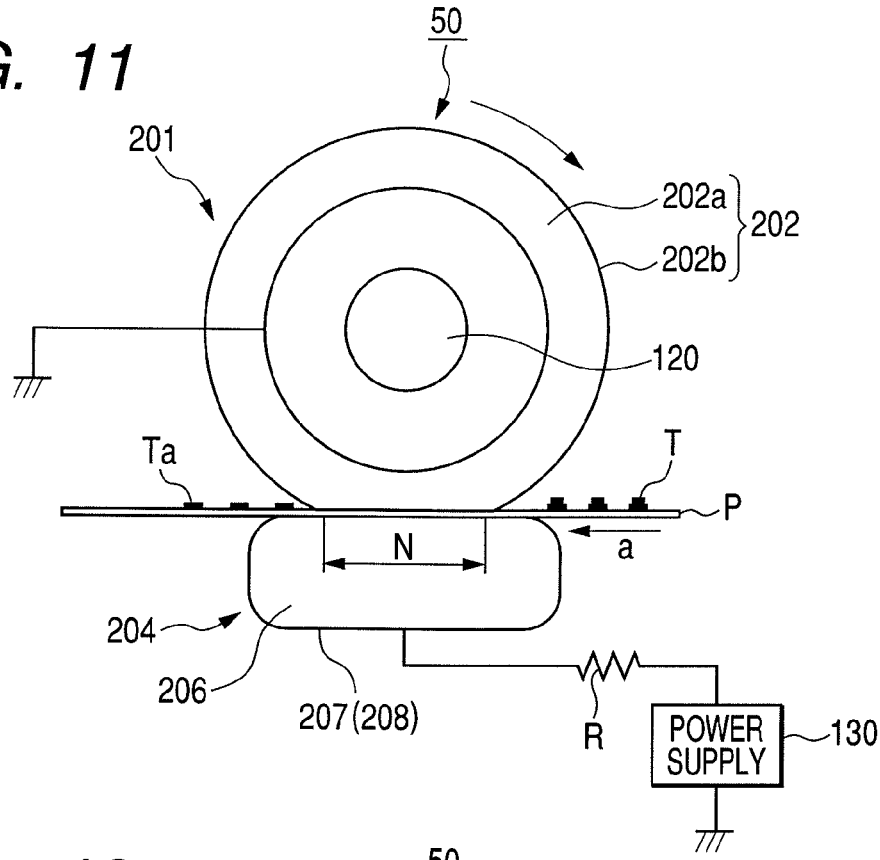
FIG. 11 is a view of an outline configuration in a further embodiment of the fixing apparatus according to the present invention.

The nip forming member 204 can be, as described above, formed as the pressure roller 204 that is the rotary member. The nip forming member 204 may also, however, be a fixed pad-shaped member which is, as illustrated in FIG. 11, composed of the conductive rubber 206 and the conductive surface layer 207 as in the case of the pressure roller 204. At this time, an available scheme is that the voltage of the power supply 130 can be, as shown in the drawing, applied directly to the conductive rubber 206 and can be also, when the cored bar 205 is provided at the central part as in the case of the pressure roller 204 shown in FIG. 9, applied to this cored bar 205.

The configuration described above has the following effects.

A first effect is that the offset can be prevented by keeping the potential relationship given above during the conveyance of the recording material P.

A second effect is that the surface potential of the pressure roller (nip forming member) 204 and the surface potential of the fixing roller (the rotary fixing member) 202 can be controlled with the high accuracy, and hence the offset can be prevented invariably with stability in a way that gets flexible to the type of the recording material P and a change in the environment.

A third effect is that the effects given above are attained by one single power supply, whereby a rise in costs can be restrained.

In the same way as by the second embodiment, according to the fifth embodiment, after conveying the recording material, during an interval till the next recording material reaches the fixing nip portion N, the control of changing over the bias to be applied is conducted. As a result, substantially the same effect as in the second embodiment can be obtained.

In the same way as by the third embodiment, according to the fifth embodiment, the environment sensor S detects the environment. The applied bias is controlled based on a result of the detection thereof. As a consequence, substantially the same effects as in the third embodiment can be acquired.

The fifth embodiment has exemplified the conductive surface layer 207 as the surface layer of the pressure roller or pressure pad 204. The configuration having the insulating surface layer 208 can, however, have substantially the same effect as in the fourth embodiment.

Sixth Embodiment

A sixth embodiment will be next described. The basic configuration of the image forming apparatus 100 in the sixth embodiment is the same as in the first embodiment discussed with reference to FIG. 1. Accordingly, the description of the image forming apparatus 100 involves quoting the description in the first embodiment.

Figure 12:
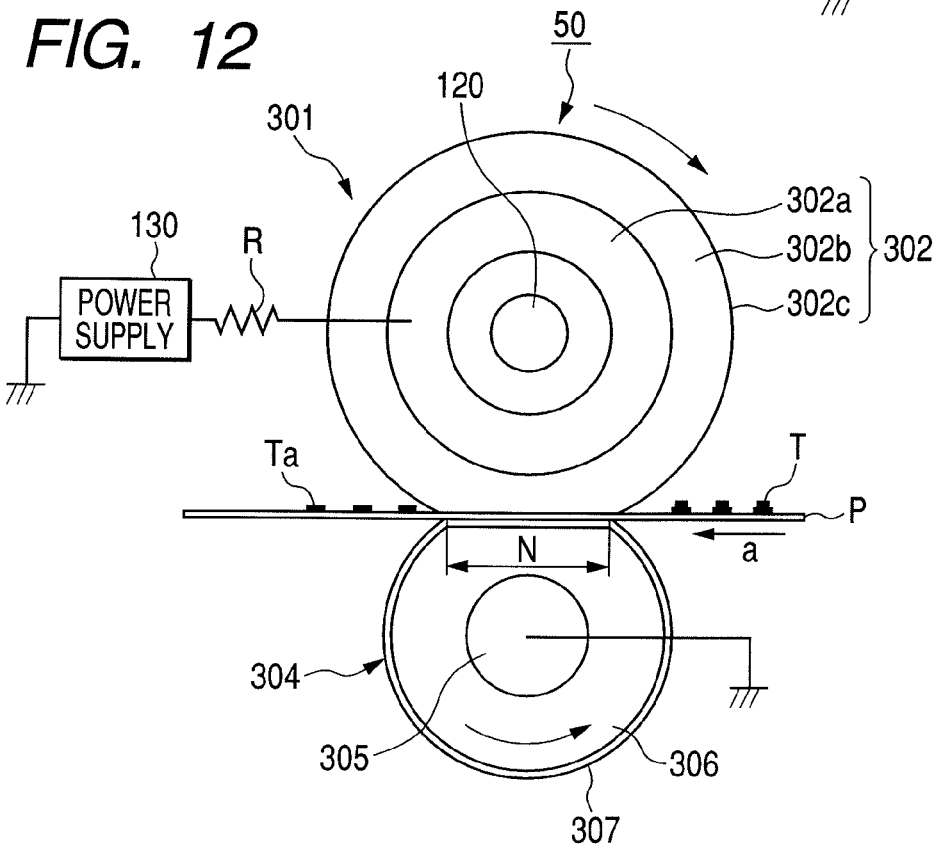
FIG. 12 is a view of an outline configuration in a still further embodiment of the fixing apparatus according to the present invention.

The fixing apparatus 50 in the sixth embodiment, however, takes the configuration illustrated in FIG. 12.

Referring to FIG. 12, the fixing apparatus 50 in the sixth embodiment includes a fixing roller 302 defined as a rotary member (the rotary fixing member) that builds up a fixing member 301 and a pressure roller 304 that is a rotary member (nip forming rotary member) serving as a nip forming member. The fixing roller 302 and the pressure roller 304 are brought into the press-contact with each other, thereby forming the fixing nip portion N.

The fixing roller 302 is a heat-resistance elastic roller constructed by disposing a conductive silicon rubber 302*b* over an aluminum cylinder 302*a* that is 25 mm in outer diameter and 2 mm in wall thickness, of which the surface is coated with a conductive coated layer 302*c*. The halogen heater 120 serving as the heating member is disposed inside the fixing roller 302. The halogen heater 120 heats up the fixing roller 302 so that a temperature thereof becomes an appropriate temperature under predetermined control.

The pressure roller 304 is a heat-resistance elastic pressure roller including a cored bar 305, a conductive silicon rubber 306 formed around the cored bar 305 and a conductive coated layer 307 coated over the surface of the conductive silicon rubber 306.

The pressure roller 304 is sufficiently pressurized toward the fixing roller 302 in order to form the fixing nip portion N necessary for heat-fixation from both of the ends in a longitudinal direction by a pressure means (unillustrated) such as a spring. The fixing roller 302 is driven to rotate by a drive gear (unillustrated) secured to an edge portion of the cored bar, whereby the pressure roller 304 is follow-rotated at a predetermined speed by dint of a friction between the surface of the pressure roller 304 and the surface of the fixing roller 302.

Figure 13:
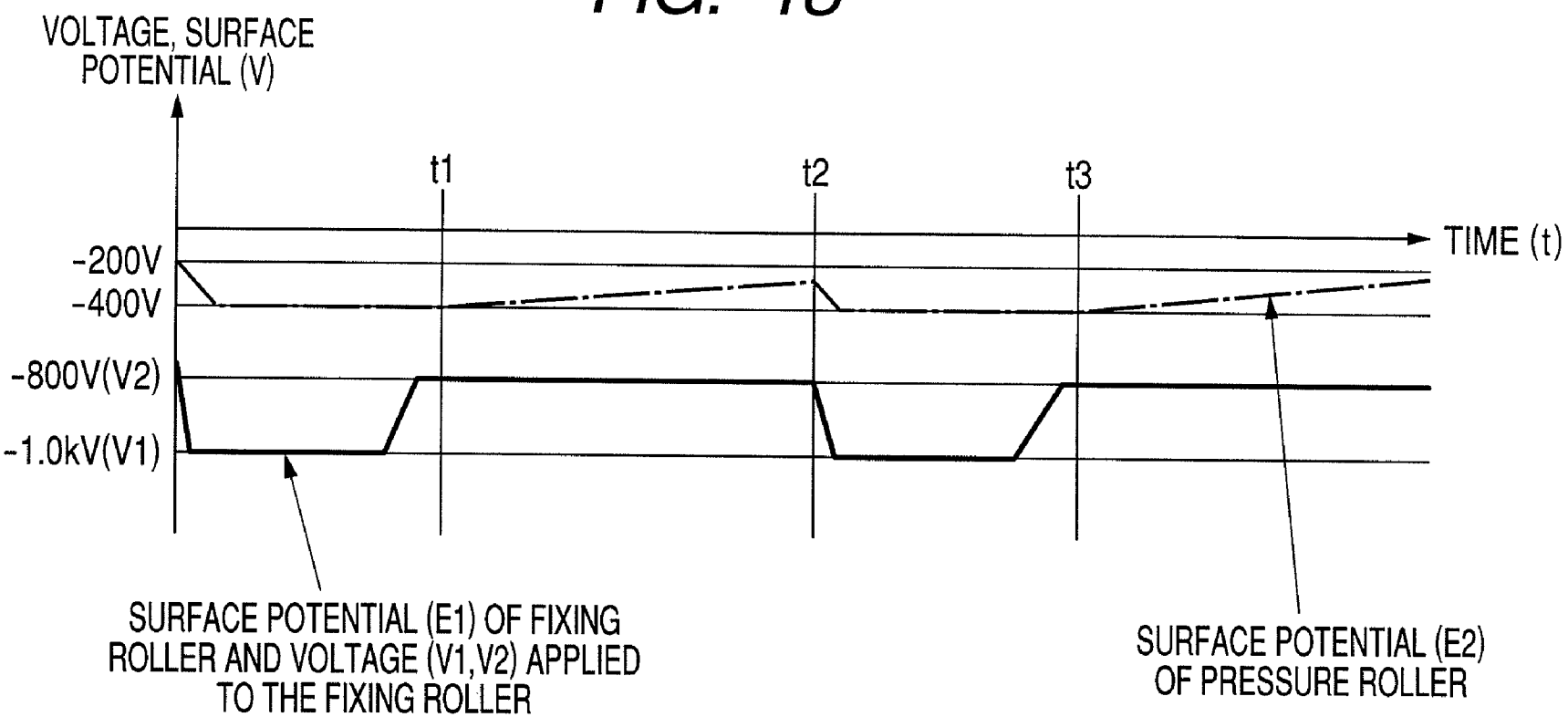
FIG. 13 is an explanatory timing chart showing the bias applying mode and the potential relationship in the fixing apparatus according to the present invention.
Figure 14:
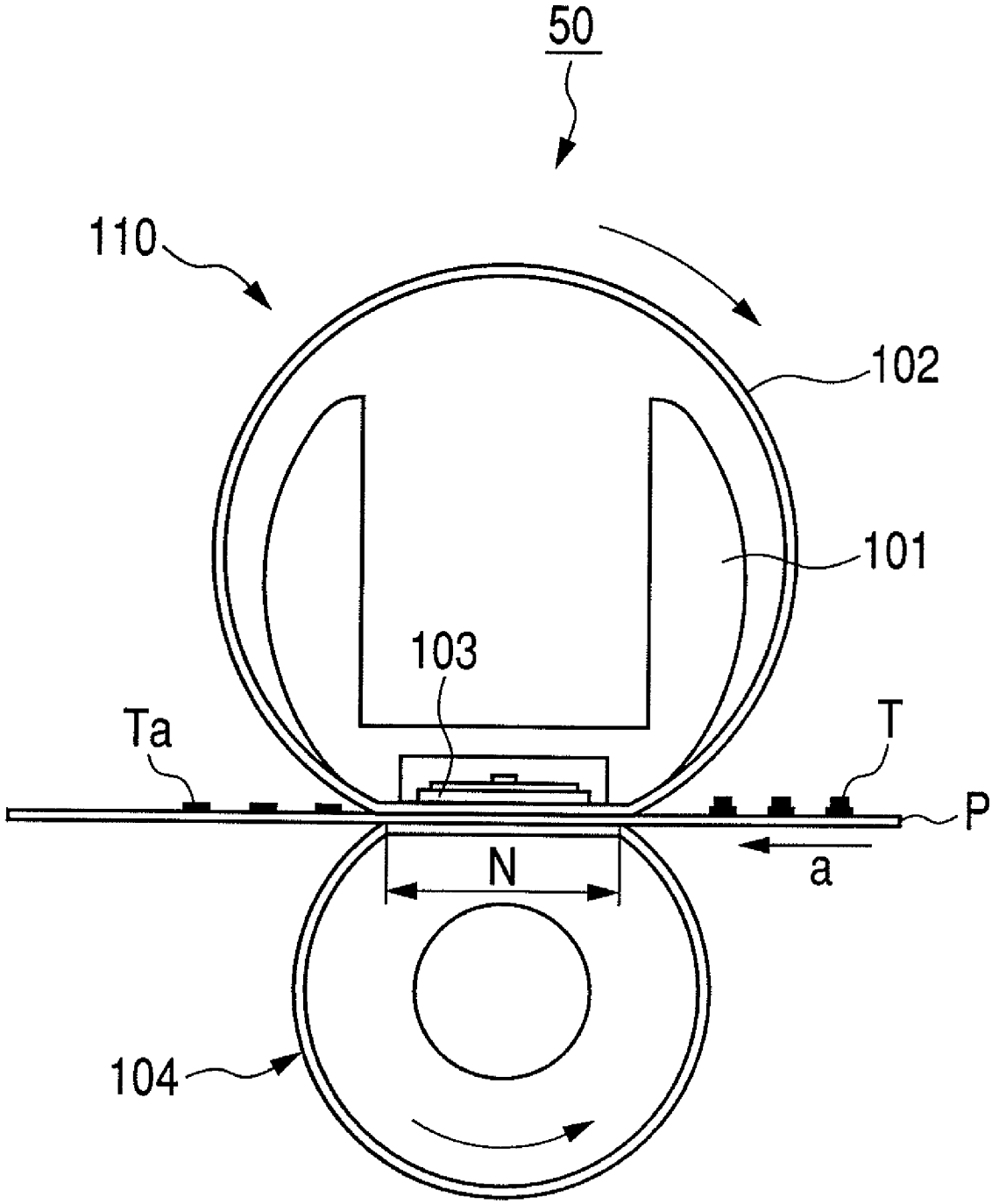
FIG. 14 is a view of an outline configuration illustrating one example of a conventional fixing apparatus.

The power supply 130 is pressed against a cored bar 302*a* of the fixing roller 302 via the resistance R and the carbon chip (unillustrated), whereby the bias having the same polarity as the toner has can be applied. The bias to be applied is, as illustrated in FIG. 13, changed over before the recording material P reaches the fixing nip portion N and in the process of the recording material P passing therethrough.

To begin with, before the recording material P reaches the fixing nip portion N, the voltage (the first vias V1) having the same polarity as the toner polarity is applied to the fixing roller 302. The voltage V1 is set at, e.g., minus 1 kV. At this time, the fixing roller 302 is composed of a conductive rubber 302*b* and a conductive surface layer 302*c*, and hence the surface potential (the surface potential E1) of the fixing roller 302 is charged at minus 1 kV.

Before applying the bias, the surface of the pressure roller 304 is charged at minus 200 V or thereabouts. When the surface of the fixing roller 302 is charged at minus 1 kV, the discharge gets started with respect to the surface of the pressure roller 304, and the surface of the pressure roller 304 is charged. The charge potential (the surface potential E2) is for example, minus 400 V. Before the recording material P reaches the fixing nip portion N, the discharge is made to occur over the entire area of the pressure roller 304 in the peripheral direction, whereby the entire surface of the pressure roller 304 comes to a state of being charged at minus 400 V. In the sixth embodiment, the recording material conveying speed (the peripheral speed of the fixing roller 302) is on the order of 240 mm/s, and the peripheral length of the pressure roller 304 is 78.5 mm. Therefore, the entire periphery of the pressure roller 304 can be charged for a period of 0.3 sec or a bit longer.

Just before the recording material P reaches the fixing nip portion N, according to the sixth embodiment, the voltage applied to the fixing roller 302 is changed over to the second vias V2 at an anterior point of 10 mm. The post-changeover voltage V2 is set at, e.g., minus 800 V. At this time, the fixing roller 302 is composed of the conductive rubber and the conductive surface layer, and hence the surface potential E1 of the fixing roller 302 is instantaneously changed over to minus 800 V that is approximately equal to the applied bias. This voltage is smaller than the discharge starting voltage with respect to the pressure roller 304, with the result that the discharge does not occur. The surface of the pressure roller 304 is the insulating surface layer, so that the surface potential E2 is kept at an as-charged potential of minus 400 V.

Namely, according to the sixth embodiment, as described above, the absolute value of the surface potential E1 of the fixing roller 302 and the absolute value of the surface potential E2 of the pressure roller 304 have a relationship such as E1>E2 before the recording material P reaches the fixing nip portion N, and have a relationship such as E1>E2 during a period when the recording material P is conveyed by the fixing nip portion N.

The potential relationship given above is namely such that the surface of the fixing roller (rotary member) 302 is, e.g., minus 800 V, the surface pressure roller (nip forming member) 304 is, e.g., minus 400 V, and the electric field thereof occurs toward the pressure roller 304 from the fixing roller 302. In this state, when conveying the recording material P, the toners on the recording material P undergo the repulsion from the surface layer of the fixing roller 302 and are further attracted toward the pressure roller 304 due to the electric field, and hence there is the high effect in the offset (see FIG. 3).

The configuration described above has the following effects.

A first effect is that the offset can be prevented by keeping the potential relationship given above during the conveyance of the recording material P.

A second effect is that the surface potential of the pressure roller (nip forming member) 304 and the surface potential of the fixing roller (the rotary member) 302 can be controlled with the high accuracy, and hence the offset can be prevented invariably with stability in a way that gets flexible to the type of the recording material and a change in the environment.

A third effect is that the effects given above are attained by one single power supply, whereby a rise in costs can be restrained.

In the same way as by the second embodiment, according to the sixth embodiment, after conveying the recording material, during an interval till the next recording material reaches the fixing nip portion N, the control of changing over the bias to be applied is conducted. As a result, substantially the same effect as in the second embodiment can be obtained.

In the same way as by the third embodiment, according to the sixth embodiment, the environment sensor S detects the environment. The applied bias is controlled based on a result of the detection thereof. As a consequence, substantially the same effects as in the third embodiment can be acquired.

As in the case of the fourth embodiment, substantially the same effect can be acquired even when using the fixing roller 302 having the insulating surface layer as a substitute for the conductive surface layer 302*c*.

It should be noted that the image forming apparatus according to the present invention is not limited to the color printer exemplified in the first embodiment but can be a mono-color image forming apparatus, and a variety of other image forming apparatuses each including the fixing apparatus known to those skilled in the art can be constructed.

While the present invention has been described with reference to exemplary embodiment, it is to be understood that the invention is not limited to the disclosed exemplary embodiments. The scope of the following claims is to be accorded the broadest interpretations so as to encompass all such modification and equivalent structures and functions.

This application claims the benefit of Japanese Patent Application No. 2007-104926, filed Apr. 12, 2007, which is hereby incorporated by reference herein in its entirety.

What is claimed is:

1. An image forming apparatus which forms a toner image on a recording material, comprising:

an image forming unit which forms an unfixed toner image on the recording material;

a rotary fixing member which is brought into contact with the unfixed toner image;

a nip forming member which forms a nip portion by coming into contact with said rotary fixing member, the nip portion pinching and conveying the recording material; and a power supply which applies a voltage to said nip forming member, wherein before a leading edge of the recording material enters the nip portion, said power supply applies a first voltage to said nip forming member during the time it takes for said rotary fixing member to complete one rotation or more, the first voltage having the same polarity as a charge polarity of the toner and being equal to or larger than a discharge starting voltage for starting a discharge to said rotary fixing member from said nip forming member, so that a surface of said rotary fixing member in a circumferential direction of said rotary fixing member is charged with the same polarity as the charge polarity of the toner.

2. An image forming apparatus according to claim 1, wherein when the recording material passes through the nip portion, said power supply applies a second voltage to said nip forming member, the second voltage having the same polarity as the charge polarity of the toner and an absolute value smaller than an absolute value of the first voltage.

3. An image forming apparatus according to claim 2, wherein the second voltage is smaller than the discharge starting voltage.

4. An image forming apparatus according to claim 2, wherein when the recording material passes through the nip portion, an absolute value of a surface potential of said rotary fixing member is larger than an absolute value of a surface potential of said nip forming member.

5. An image forming apparatus according to claim 1, wherein said rotary fixing member includes an endless belt, and wherein said image forming apparatus further comprises a heater which contacts an inner peripheral surface of said endless belt and forms the nip portion together with said nip forming member via said endless belt.

6. An image forming apparatus which forms a toner image on a recording material, comprising:

an image forming unit which forms an unfixed toner image on the recording material;

a rotary fixing member which is brought into contact with the unfixed toner image;

a nip forming member which forms a nip portion by coming into contact with said rotary fixing member, the nip portion pinching and conveying the recording material; and a power supply which applies a voltage to said rotary fixing member, wherein before a leading edge of the recording material enters the nip portion, said power supply applies a first voltage to said rotary fixing member during the time it takes for said nip forming member to complete one rotation or more, the first voltage having the same polarity as a charge polarity of the toner and being equal to or larger than a discharge starting voltage for starting a discharge to said nip forming member from said rotary fixing member, so that a whole surface of said nip forming member in a circumferential direction of said nip forming member is charged with the same polarity as the charge polarity of the toner.

7. An image forming apparatus according to claim 6, wherein when the recording material passes through the nip portion, said power supply applies a second voltage to said rotary fixing member, the second voltage having the same polarity as the charge polarity of the toner and an absolute value smaller than an absolute value of the first voltage.

8. An image forming apparatus according to claim 7, wherein the second voltage is smaller than the discharge starting voltage.

9. An image forming apparatus according to claim 7, wherein when the recording material passes through the nip portion, an absolute value of a surface potential of said rotary fixing member is larger than an absolute value of a surface potential of said nip forming member.

10. An image forming apparatus according to claim 6, wherein said rotary fixing member includes an endless belt, and wherein said image forming apparatus further comprises a heater which contacts an inner peripheral surface of said endless belt and forms the nip portion together with said nip forming member via said endless belt.

* * * * *